US007055562B2

(12) United States Patent
Schöler

(10) Patent No.: US 7,055,562 B2
(45) Date of Patent: Jun. 6, 2006

(54) APPARATUS FOR COMMINUTING WOOD BOARD STACKS TO STRANDS

(75) Inventor: Michael Schöler, Rheurdt (DE)

(73) Assignee: Siempelkamp Maschinen-und Anlagenbau GmbH & Co. KG, Krefeld (DE)

( * ) Notice: Subject to any disclaimer, the term of this patent is extended or adjusted under 35 U.S.C. 154(b) by 14 days.

(21) Appl. No.: 10/851,995

(22) Filed: May 21, 2004

(65) Prior Publication Data

US 2005/0016628 A1 Jan. 27, 2005

(30) Foreign Application Priority Data

May 23, 2003 (DE) ..... 103 23 824

(51) Int. Cl.
*B27C 1/00* (2006.01)

(52) U.S. Cl. ..... 144/162.1; 144/172; 144/176; 144/180; 144/242.1

(58) Field of Classification Search ..... 144/172, 144/180, 245.2, 245.6, 176, 242.1, 245.1, 144/373, 162.1; 241/283
See application file for complete search history.

(56) References Cited

U.S. PATENT DOCUMENTS

| | | | | | |
|---|---|---|---|---|---|
| 4,583,574 | A | * | 4/1986 | Pallmann | 144/250.11 |
| 4,784,198 | A | * | 11/1988 | Pallmann | 144/373 |
| 5,070,918 | A | * | 12/1991 | Pallmann | 144/172 |
| 5,323,975 | A | * | 6/1994 | Fulghum, Jr. | 241/92 |
| 5,417,263 | A | * | 5/1995 | Jorgensen | 144/176 |
| 5,647,417 | A | * | 7/1997 | Schaefer et al. | 144/172 |
| 5,762,122 | A | * | 6/1998 | Rice, Sr. | 144/373 |
| 5,829,500 | A | * | 11/1998 | Van Elten | 144/185 |
| 5,934,348 | A | * | 8/1999 | Dietz | 144/357 |
| 6,026,872 | A | | 2/2000 | Leitinger | |
| 6,035,910 | A | * | 3/2000 | Schaefer | 144/369 |

* cited by examiner

*Primary Examiner*—Bena Miller
(74) *Attorney, Agent, or Firm*—Andrew Wilford

(57) ABSTRACT

An apparatus for comminuting a stack of wood boards to produce wood strands. A stack feeder feeds the stack of wood boards to a chipper chamber on a longitudinally displaceable carriage moving transverse to the direction of feed of the stack and having a blade ring for comminuting the end of the stack. The chamber is reduced in full volume with replaceable and removable filler bodies.

7 Claims, 4 Drawing Sheets

APPARATUS FOR COMMINUTING WOOD BOARD STACKS TO STRANDS

FIELD OF THE INVENTION

The present invention relates to an apparatus for comminuting stacks of wood boards to produce strands, particularly for use in the production of oriented strand board and other particle board products.

BACKGROUND OF THE INVENTION

It is known to produce elongated chips of wood, hereinafter referred to as strands, by comminuting round pieces of wood. For that purpose, an apparatus is provided which comprises a wood feeder and a longitudinal wood chipper which can have a blade ring chipping unit displacable in a direction transverse to the wood and across an end thereof at which the chipping is effected.

That apparatus has a chipping chamber which is provided at its lower region with a bottom structure and in its upper region with a cover segment. On one side of this chamber a chipping path is provided and on the opposite side a stationary support projects into the chipping chamber and provides a stop for the boards against which the boards are supported for the cutting action from the opposite side. The stack of boards can be advanced with successive cuts as the blade ring is displaced back and forth along its longitudinal guide transverse to the direction of advance of the stack.

Such chippers have been used to produce strands of a given length, width and thickness from round pieces of wood and the blade ring which extends through the chipping chamber and is displaced from the chipping path side toward the stop member is designed to thus comminute the pieces of wood. The chipping effectiveness of this apparatus which is designed to cut up round pieces of wood, is unsatisfactory when attempts are made to cut up boards or stacks of boards. Indeed, the packing density of the wood in the chipping chamber for a given volume is only about 50% while the packing density of a stack of boards is around 80 to 90% or more than 50% greater. The chipping power utilized with round pieces of wood is insufficient for such stacks and by and large the quality of the chipping operation is greatly limited when attempts are made to use stacks of boards in such an apparatus.

OBJECTS OF THE INVENTION

It is the principal object of the present invention to provide an improved apparatus for producing strands from wood and particularly from a stack of wood boards, whereby drawbacks of the earlier apparatus are avoided.

It is a more specific object of the invention to enable the use of a wood strand chipper of the type hitherto used for round pieces of wood, for stacks of wood boards without the disadvantages which have been encountered heretofore in such efforts.

Still another object of the invention is to provide an apparatus which can be designed for the chipping of round pieces of wood to produce wood strands and yet can be retrofitted to enable the comminution of wood boards while maintaining the chipping efficiency which was obtained with such round pieces of wood.

Yet another object of this invention is to provide a wood chipper for producing strands from a stack of wood boards with high efficiency and free from drawbacks of earlier apparatus.

SUMMARY OF THE INVENTION

These objects are achieved, in accordance with the invention in an apparatus for the comminution of a stack of wood boards to produce strands and which comprises a stack feeder for advancing the stack of wood boards in their longitudinal directions, a longitudinally displacable chipper unit with a blade ring shiftable across an end of the stack transversely to the direction of advance of the stack and the boards and whereby the blades of that ring cut the wood, i.e. chip the wood, into strands, and one or more releasable filling bodies receivable in the chipping chamber for reducing the remaining volume thereof.

With such replaceable filling bodies or members, it is possible to convert a chipping apparatus designed for the chipping of round pieces of wood to a chipper for a stack of boards while maintaining the chipping efficiency. It is indeed surprising that simply by equipping the chipping chamber with replaceable filler bodies and thereby reducing the free volume of the chamber, the apparatus can be converted in a simple and reliable manner to board stack chipping without loss in chipping efficiency or effectiveness. The apparatus of the invention can be operated continuously or cyclically advanced into the chipping chamber. The stack of wood boards can be formed from boards which are uniformly sawn to a given length, width and thickness with the stacking being formed directly in the trough by laying the boards in individually. Alternatively, prepared wood board stacks can be supplied which have widths that are basically a multiple of the blade length of the longitudinal wood chipper apart from a limited tolerance. Preferably wood boards are used which have a moisture content of at least 85% of that of the green wood.

The chipping apparatus of the invention can, because of the significant reduction in the space available in the chipping chamber, can operate with a smaller working stroke and shorter cycling time (duration between advances of the blade ring) than with round wood chipping. Nevertheless an especially effective chipping of the wood in the form of boards can be achieved.

According to the invention, moreover, the filler bodies or members are connectable to or adjoin the bottom structure and the cover segment and/or the abutment and can be releasably connected thereto, for example, by screws or bolts. The upper and lower filler bodies have edges which are turned toward the chipping side and conform to the internal radius of the chipping path to reduce any gap formation to the greatest extent possible or to avoid the formation of gaps. The filler bodies are preferably configured as plate elements.

Since the chipping chamber of a chipping apparatus designed for the chipping of round pieces of wood as a rule has a convex abutment matching the opposite chipping path, in accordance with the invention, the filler bodies associated with such convex abutments will have correspondingly curved outer surfaces and concave surfaces where they engage the abutment to match or be complementary to the abutment surface.

According to a feature of the invention the wood stack guide device is formed as a conveyor trough with a shifting unit for advancing the stack. The invention provides in addition for one or more weighting towers above the stack which can bear upon the boards of the stack and hold the stack together within the trough or chute.

Surprisingly, it has been found that it is not necessary to provide a clamping system for the boards. A weighting of the boards directly upstream of the chipping chamber will suffice when the chipping chamber itself is uniformly reduced in its free volume by filler bodies from above and below.

The width of the chipping chamber can be reduced to an optional extent as well.

The chipping of the stack is, as noted, effected by a back and forth displacement of a longitudinal wood chipper with its rotating blade crown as the latter is advanced through the chipping chamber and cuts up the portion of the wood stack which has been advanced into the latter against an abutment which is stationary and projects axially into the chipping chamber.

Surprisingly, the invention thus is a blade ring chipper without a clamping device but which nevertheless operates in a highly economical manner and with high yield to generate strands from boards not only with a designed chipping width but even more surprisingly also with a designed chip length.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
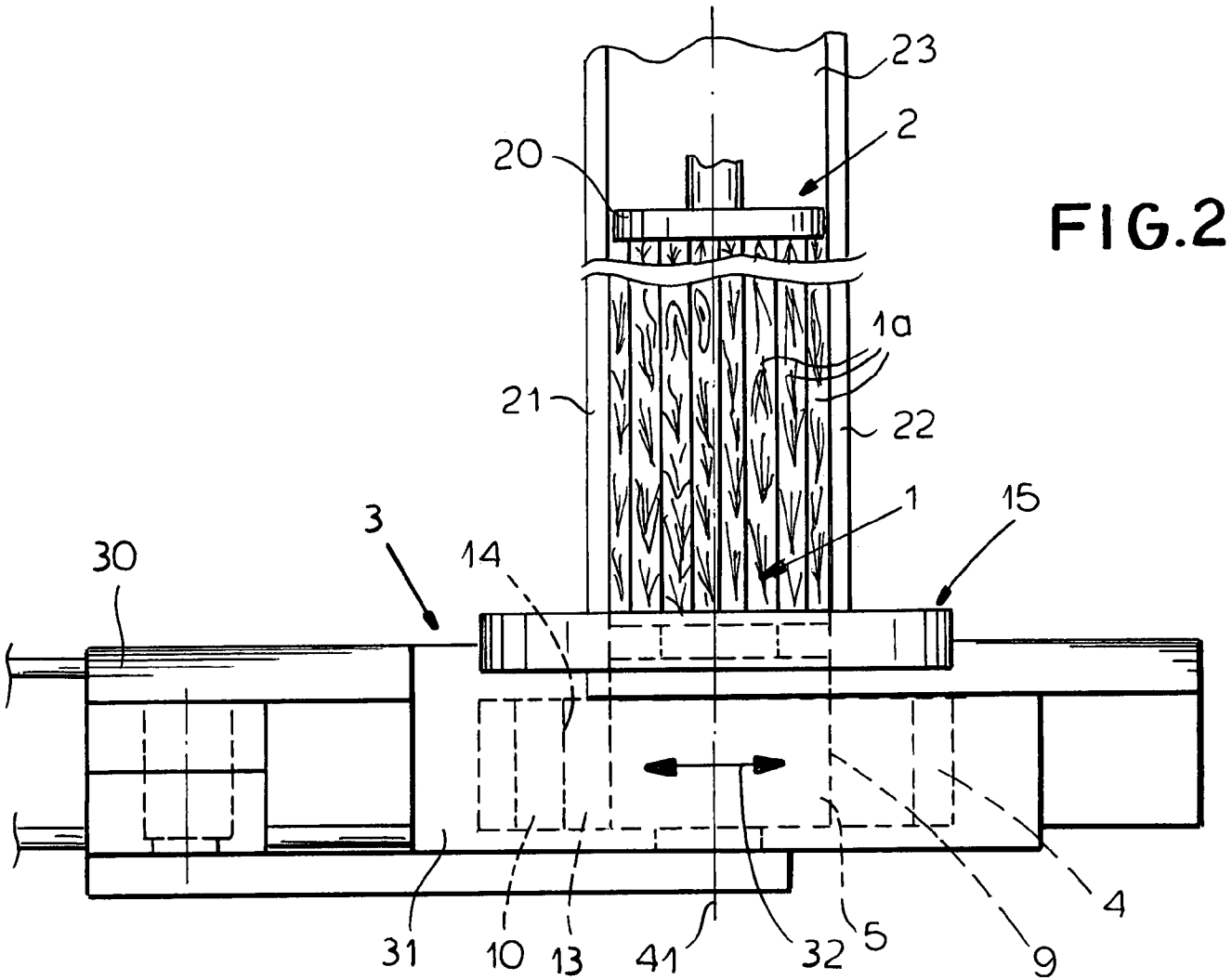
FIG. 2 is a plan view of the apparatus of FIG. 1.
Figure 3:
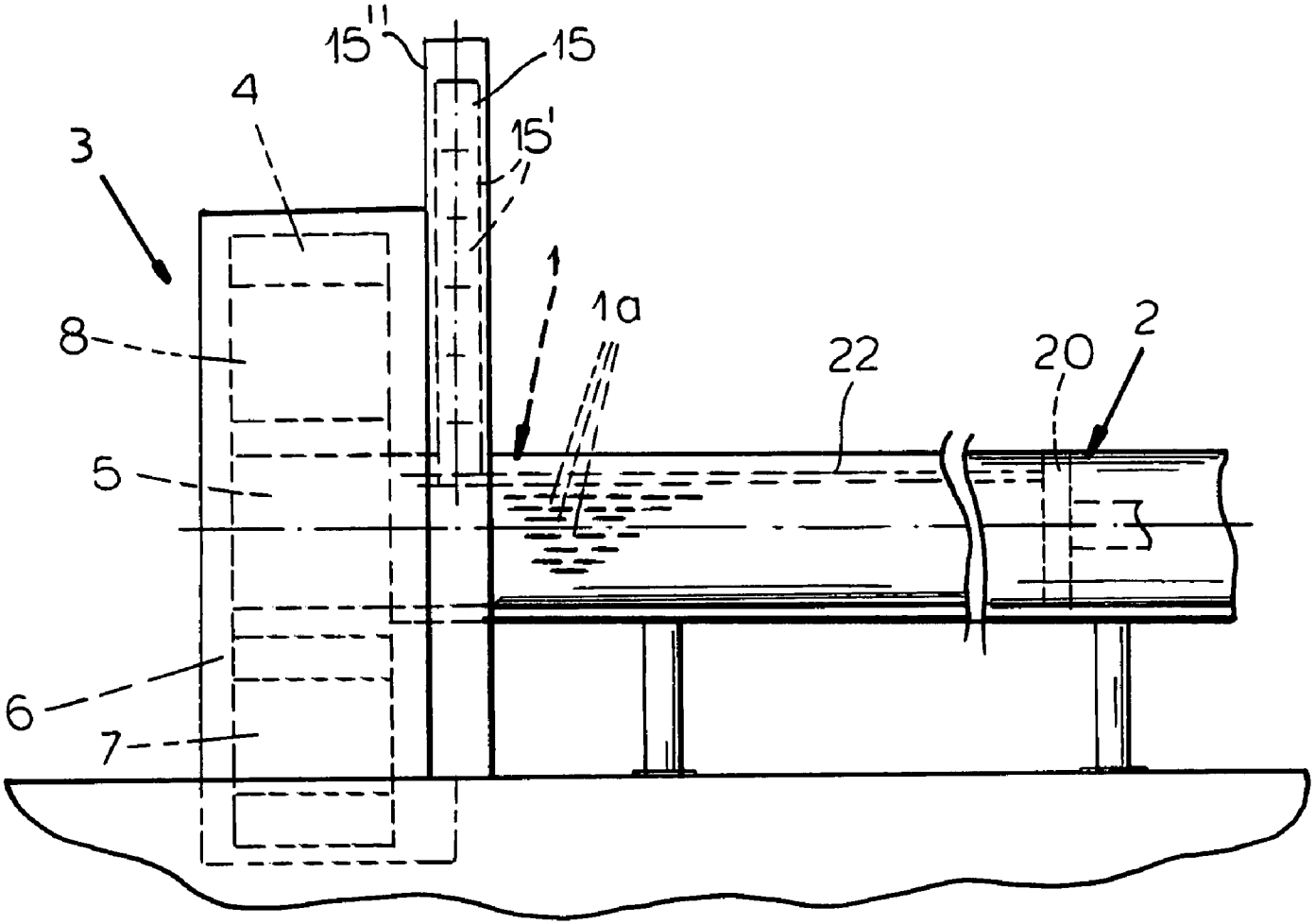
FIG. 3 is a side view of this apparatus.

In the drawing, I have shown an apparatus for the comminution of wood-board stacks 1 to strands, e.g. for the production of oriented strand board. The apparatus basically comprises a trough-shaped stack-guide unit 2 with shifting device 20 (FIG. 2) for advancing the stack composed of the wood boards 1*a* to the chipping chamber which will be described in greater detail hereinafter. The feeder 2 can comprise a pair of side walls 21 and 22 defining the trough which has a bottom 23 (FIGS. 2 and 3).

Figure 1:
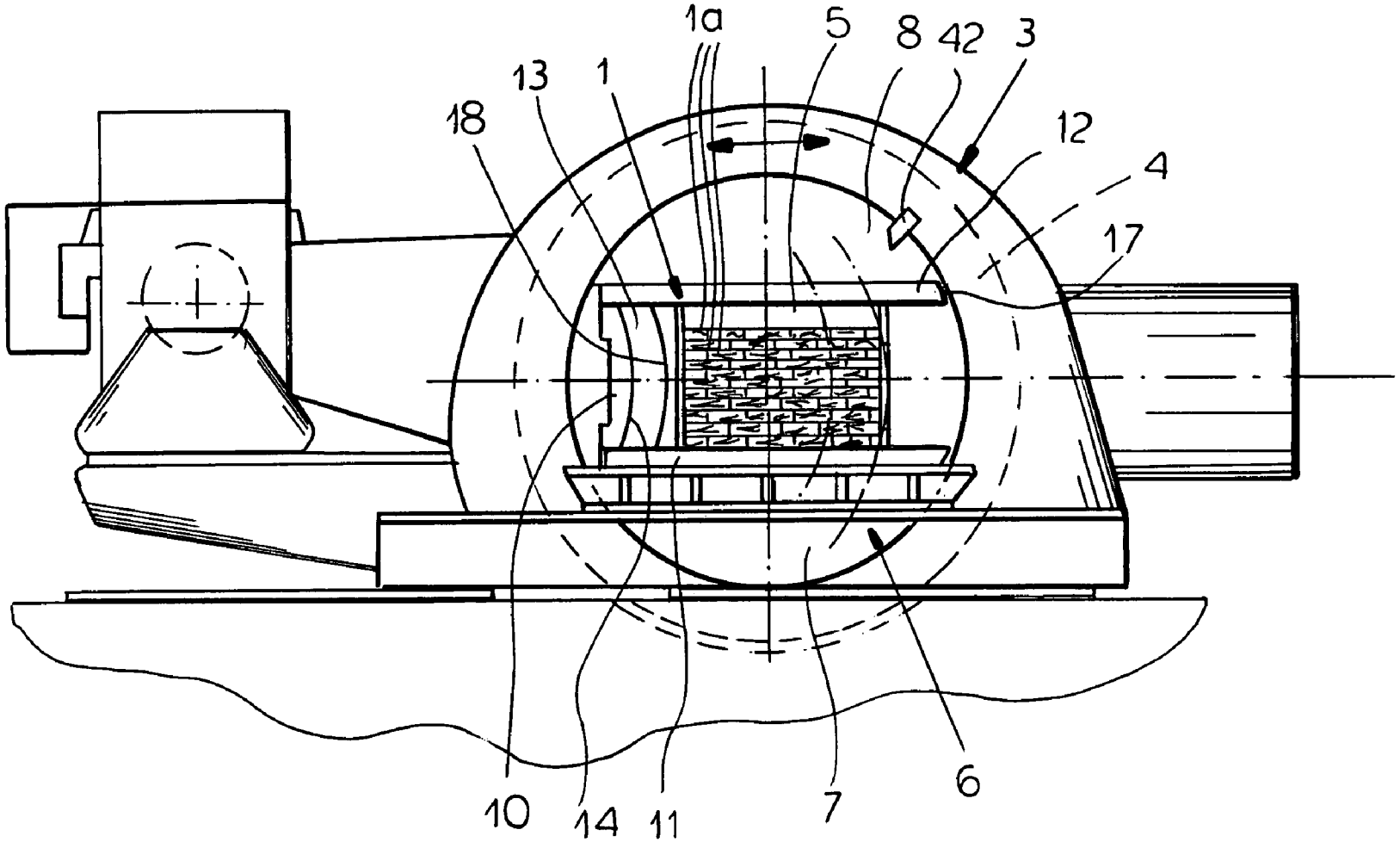
FIG. 1 is a diagrammatic front view of the strand-forming chipper according to the invention, showing the chipping chamber from the front as well.

At the end of the feeder 2, there is a longitudinal wood chipper 3, also referred to as a blade ring chipper, which can comprise a longitudinal guide 30 along which a carriage 31 is displaceable back and forth in the direction of the double headed arrow 32. The carriage 31 is provided with a blade ring 4 which is rotatable about the axis 41 by a drive not shown and can have chipper blades in a crown and one only of which has been shown at 42 in FIG. 1. A suitable construction of the blade ring is a blade ring configuration as described in, for example, U.S. Pat. No. 4,583,574 and/or U.S. Pat. No. 6,554,032. The blade ring 4 can surround a chipper chamber 5. For the most part, the circular boundary of the chipper chamber 5 and the blade ring or crown 4 has been indicated only diagrammatically.

The chipper chamber 5 is delimited at its lower region or bottom by a bottom structure 6 with a bottom segment 7 of circular arc shape. At its upper region, the chamber is delimited by a circular arc shaped covered segment 8.

Figure 4:
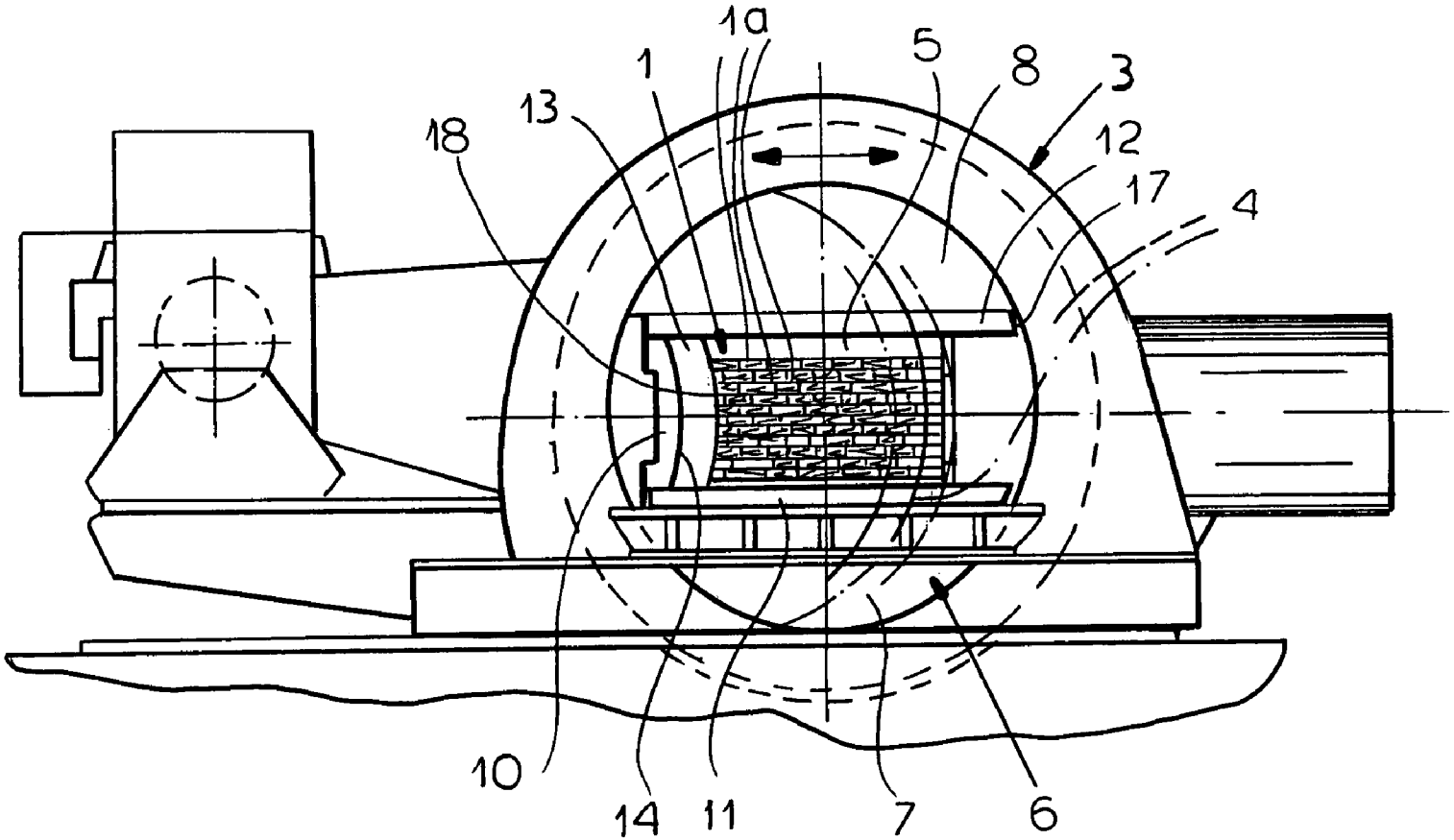
FIG. 4 is a detail of the apparatus showing another position of the blade ring.

On one side of the chipper chamber 5, the blade ring or crown 4 delimits the chamber while on the opposite side of the chamber there is a stationary abutment 10 which projects axially into the chamber and can be fixed on a stationary portion of the structure, for example, the guide 30 and can be cantilevered therefrom. The successful positions of the blades as they sweep across the end of the stack 1 moving from right to left have been shown in dot dash lines in FIGS. 1 and 4 as the blades of the ring 4 chip the wood to produce the strands. The stack is advanced toward the chamber by the unit 20 previously described.

The free volume of the chipper chamber 5 or the strand receiving volume is reduced when wood stacks are to be chipped by the insertion of releasable and movable filler bodies or pieces 11, 12 or 13 which can be connected to the bottom structure 6, the cover segment and/or the abutment 10. The upper and lower filler bodies 11 and 12 can have edges 17 which follow the curvature and have radii of curvature corresponding to that of the inner radius of the chipper path 9. The filler bodies 11, 12 and 13 can be plate elements and the filler body which is applied to the abutment 10 can have, in the case of a convex abutment as shown, a concave curvature 14 corresponding to the convex curvature of that abutment 10. The outer curvature 18 of the filler body 13 may follow the curvature of the blade ring and the curvature of the abutment 10 and can have the same center of curvature. The curvature 18 in particular may have the same radius of curvature as the internal radius of the chipper path 9.

As has been previously noted, a special clamping of the boards 1*a* is not required and it is nevertheless advantageous to hold the stack together with at least one weighting column 15 which is located directly adjacent the carriage 31 and comprises a multiplicity of weights 15' loaded into a guide 15" (FIG. 3).

I claim:

1. An apparatus for comminuting a stack of wood boards to produce wood strands, said apparatus comprising:

a wood board stack feeder for advancing a stack of wood boards in a direction;

a chipper chamber at an end of said feeder receiving an end of said stack and delimited at a bottom by a bottom structure and at a top by a cover segment;

a longitudinal wood chipper at said end of said feeder comprising a guide extending longitudinally transverse to said direction and to the boards of said stack, and a blade ring displaceable along said guide and through said chipper chamber from one side of a chipping path to an opposite side of said chipping path at which said stack is supported by a cantilevered abutment projecting into said chamber, whereby blades of said ring comminute said end of said stack into wood strands in said chipper chamber; and respective upper and lower replaceable and removable filler bodies on said cover segment and on said bottom structure in said chamber for reducing free space therein by a predetermined amount, said upper and lower filler bodies on said cover segment and said bottom structure have at respective edges turned toward said blade ring on said one side of said chipping path having edges rounded to correspond to the internal radius of the chipping path.

2. The apparatus defined in claim 1 wherein a respective said filler body is provided on said abutment.

3. The apparatus according to claim 2 in which the filler body on said abutment has a concave surface corresponding to and seating onto a convex surface of said abutment and a convex surface turned toward said one side of said chipping path with a radius of curvature corresponding to an internal radius of said chipping path.

4. The apparatus defined in claim 1 wherein said filler bodies are configured as plate elements.

5. The apparatus according to claim 4 in which a filler body on said abutment has a concave surface corresponding to and seating onto a convex surface of said abutment and a convex surface turned toward said one side of said chipping path with a radius of curvature corresponding to an internal radius of said chipping path.

6. The apparatus defined in claim 5 further comprising a weighing tower for holding boards of said stack together directly adjacent the longitudinal wood chipper at said end of said feeder.

7. The apparatus defined in claim 1 further comprising a weighing tower for holding boards of said stack together directly adjacent the longitudinal wood chipper at said end of said feeder.

* * * * *